US007278537B2

(12) United States Patent
Lown et al.

(10) Patent No.: US 7,278,537 B2
(45) Date of Patent: Oct. 9, 2007

(54) PORTABLE GIFT WRAPPING CENTER FOR STORING WRAPPING AND STATIONARY SUPPLIES AND FACILITATING THE USE THEREOF

(75) Inventors: John M. Lown, Huntington Beach, CA (US); Ali Nikkhah, Mission Viejo, CA (US)

(73) Assignee: Snapware Corporation, Mira Loma, CA (US)

( * ) Notice: Subject to any disclaimer, the term of this patent is extended or adjusted under 35 U.S.C. 154(b) by 443 days.

(21) Appl. No.: 11/094,981

(22) Filed: Mar. 31, 2005

(65) Prior Publication Data

US 2006/0219580 A1 Oct. 5, 2006

(51) Int. Cl.

| | |
|---|---|
| ***B65D 5/52*** | (2006.01) |
| ***B65D 69/00*** | (2006.01) |
| ***A47B 37/00*** | (2006.01) |

(52) U.S. Cl. ..... 206/45.24; 206/225; 206/575; 108/50.17; 108/129; 190/11; 220/254.6; 312/241

(58) Field of Classification Search .. 206/45.24–45.27, 206/223, 225, 391, 394, 575; 108/11, 14, 108/28, 116, 50.11, 50.17, 121, 125, 129; 190/1, 11; 220/254.1, 254.3, 254.6, 254.8, 220/810, 826; 312/237, 240, 241
See application file for complete search history.

(56) References Cited

U.S. PATENT DOCUMENTS

| | | | | |
|---|---|---|---|---|
| 3,156,510 | A * | 11/1964 | Hindin et al. | 108/129 |
| 4,186,833 | A | 2/1980 | Homan | |
| 4,471,969 | A * | 9/1984 | Zabala et al. | 108/129 |
| 6,006,502 | A | 12/1999 | Smith | |
| 6,068,355 | A * | 5/2000 | Thorp | 312/241 |
| 6,123,197 | A | 9/2000 | Marquez et al. | |
| 6,266,942 | B1 | 7/2001 | McClorey | |
| 6,311,627 | B1 | 11/2001 | Draper et al. | |
| 6,612,436 | B1 | 9/2003 | Zullo | |
| 6,698,589 | B1 | 3/2004 | Johnson | |
| 6,725,753 | B2 | 4/2004 | Bell | |
| 2003/0106821 | A1 * | 6/2003 | Bar-Erez | 206/373 |
| 2004/0129123 | A1 | 7/2004 | Miller | |
| 2006/0037873 | A1 * | 2/2006 | Elgart | 206/223 |

* cited by examiner

*Primary Examiner*—Luan K. Bui
(74) *Attorney, Agent, or Firm*—Harold L. Jackson

(57) ABSTRACT

A portable gift wrapping center includes a storage compartment having a storage area for accommodating rolls of wrapping paper and accessories. A primary lid is hinged to the back wall of the compartment and defines a centrally located shallow storage area for writing paper, cards, etc., with the top surface of the primary lid defining a plurality of orthogonal grooves. A secondary lid, hinged to the primary lid, for enclosing the shallow storage area. A plurality of foldable legs are hinged to the bottom wall of the compartment to allow the table to be raised to a desired height in the deployed position or stored under a conventional bed in the retracted position.

31 Claims, 12 Drawing Sheets

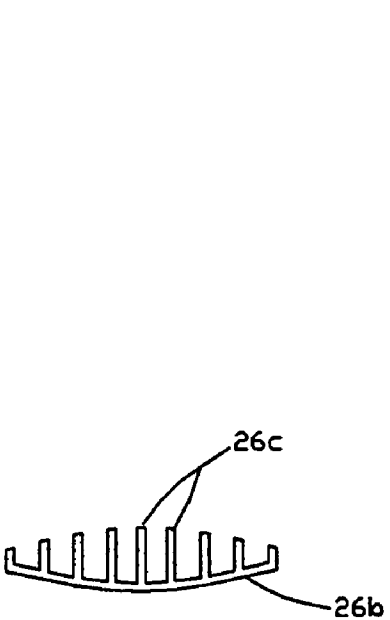
Figure 10
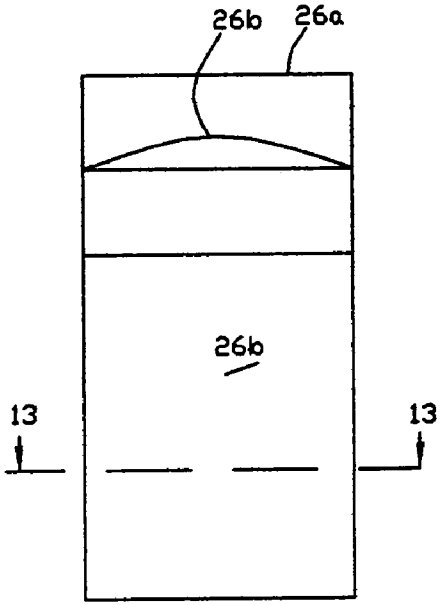
Figure 11
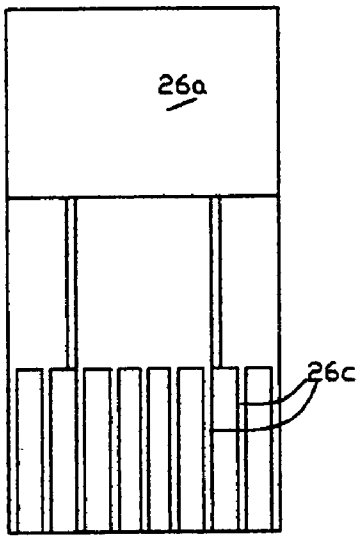
Figure 12
Figure 13

PORTABLE GIFT WRAPPING CENTER FOR STORING WRAPPING AND STATIONARY SUPPLIES AND FACILITATING THE USE THEREOF

FIELD OF THE INVENTION

The present invention relates to a gift wrapping center for facilitating gift wrapping, and more particularly, such a center is portable with compartments for storing wrapping and stationary supplies and facilitating their use.

BACKGROUND OF THE INVENTION

Utility tables capable of storing wrapping materials are known in the art. For example, U.S. Pat. No. 6,311,627 ("'627 patent") discloses an article wrapping table assembly with folding legs, an inner compartment for storing rolls of wrapping paper, a slidable drawer, a pair of opposed cut outs on one end of the table for supporting a roll of paper and a flat upper surface for receiving paper unraveled from the roll. However, only the end roll of paper is readily accessible from the inner compartment and it is not clear how rolls of a length to fit within the compartment could be fitted in the cut outs.

U.S. Publication No. US2004/0129123 A1 ("'123 publication") discloses a gift wrapping box with an upper compartment for storing rolls of paper with an open end from which the end roll may be removed, a pair of roll holding clips mounted along the open end of the compartment, and a upper surface for supporting the article to be wrapped. The '123 box, like the '627 table, suffers from the disadvantage that only the end roll is readily accessible. In addition, the '123 work box is not provided with legs to allow the station to be readily raised to a convenient table height. Also, the wrapping accessories are stored in the same compartment as the paper rolls apparently requiring that all such accessories be removed prior to the removal of a paper roll.

Another gift wrapping box, disclosed in U.S. Pat. No. 6,266,942, ("'942 patent") has a hinged lid overlying a compartment for holding paper rolls, a pull out drawer for storing wrapping accessories, and a roller detachably mounted at one end of the box on which a roll of paper can be inserted. The '942 box, like the '123 box, is not provided with legs. In addition, the paper roll dispensing roller is mounted inside the box.

U.S. Pat. No. 6,006,502 ("'502 patent") discloses afoldable wrapping station with pull out drawers for holding wrapping materials portioned under a grooved platform which allows a user to determine the amount of paper needed for a particular article and cut the paper along a groove. The '502 station has trays at each end for supporting a paper roll, but does not have legs or illustrate any means for storing rolls of wrapping paper.

While the above devices facilitate gift wrapping they all have certain shortcomings. There is a need for a more convenient portable gift wrapping center for storing wrapping as well as stationary supplies and facilitating the use thereof.

SUMMARY OF THE INVENTION

A portable gift wrapping center, in accordance with present invention, includes a rectangular storage compartment with a bottom wall and front, rear and opposed side walls extending upwardly from the bottom and terminating in a peripheral rim. The compartment includes a main storage area for accommodating the storage of a plurality of conventional wrapping paper rolls. The compartment further defines at least one separate storage area for accommodating wrapping accessories such as ribbon, tape, scissors, etc.

A primary lid, hinged to the back compartment wall and overlying the compartment peripheral rim is formed with a centrally located shallow open third storage area for holding sheets of writing paper, cards and writing instruments. Preferably, the top surface of the primary lid defines a plurality of orthogonal grooves preferably with predetermined spacing between parallel grooves to provide guide lines for cutting wrapping paper placed thereon.

A secondary lid is preferably hinged to the primary lid for enclosing the third storage area with the top surface of the lids providing a flat work surface for supporting an article to be wrapped. Preferably an area of the top surface of the secondary lid forms a substantially smooth writing surface. The top surface of the secondary lid outside of the writing surface may also include grooves which mate with the grooves on the primary lid.

Preferably, a plurality of table legs are pivotally connected to the compartment bottom wall adjacent the side walls to allow the center to be raised to conventional table height or folded to allow the center to be stored under a conventional bed.

Preferably the center includes a utility module or basket open at the top and dimensioned to be positioned within the separate compartment storage area with cooperating means located on one side wall of the module and the compartment side walls to allow the module to be releasably mounted on either side wall of the compartment. The cooperating mounting means are preferably in the form of a pair of spaced receptacles formed in each compartment side wall and a post on a side of the utility module for insertion into the receptacle(s).

The utility module includes means such as a horizontally oriented post for supporting a roll of adhesive tape which will be accessible to a user with the lids closed. A rod for supporting a plurality of ribbon rolls may also be releasably supported in the module. A pair of wrapping paper roll support clips are preferably provided, each having a post arranged to be inserted into one of the compartment side wall receptacles so that a roll of wrapping paper may be retained adjacent the selected compartment side wall and preferably above the work surface. The roll clips preferably have a upper c-section open to the work surface when the posts are installed into the receptacles, with the c-section of the clips functioning as spring members to put a modest pressure on the paper as it is unraveled from the support roll.

The center/table is multipurpose and can also be used as an activity center, e.g., for scrapbooking, as a home work station for students, as a play table, etc.

It is to be noted that the center can be used to facilitate scrap booking activities.

The features and construction of the table assembly may best be understood by reference to the following description taken in conjunction with the appended drawings.

BRIEF DESCRIPTION OF THE DRAWINGS

FIGS. 10, 11 and 12 are a side elevational view, a front view and a rear view of a wrapping paper roll holding clip, respectively;

FIG. 13 is a cross-sectional view of the clip of FIG. 11 taken along lines 13-13;

DESCRIPTION OF THE PREFERRED EMBODIMENT

Figure 1:
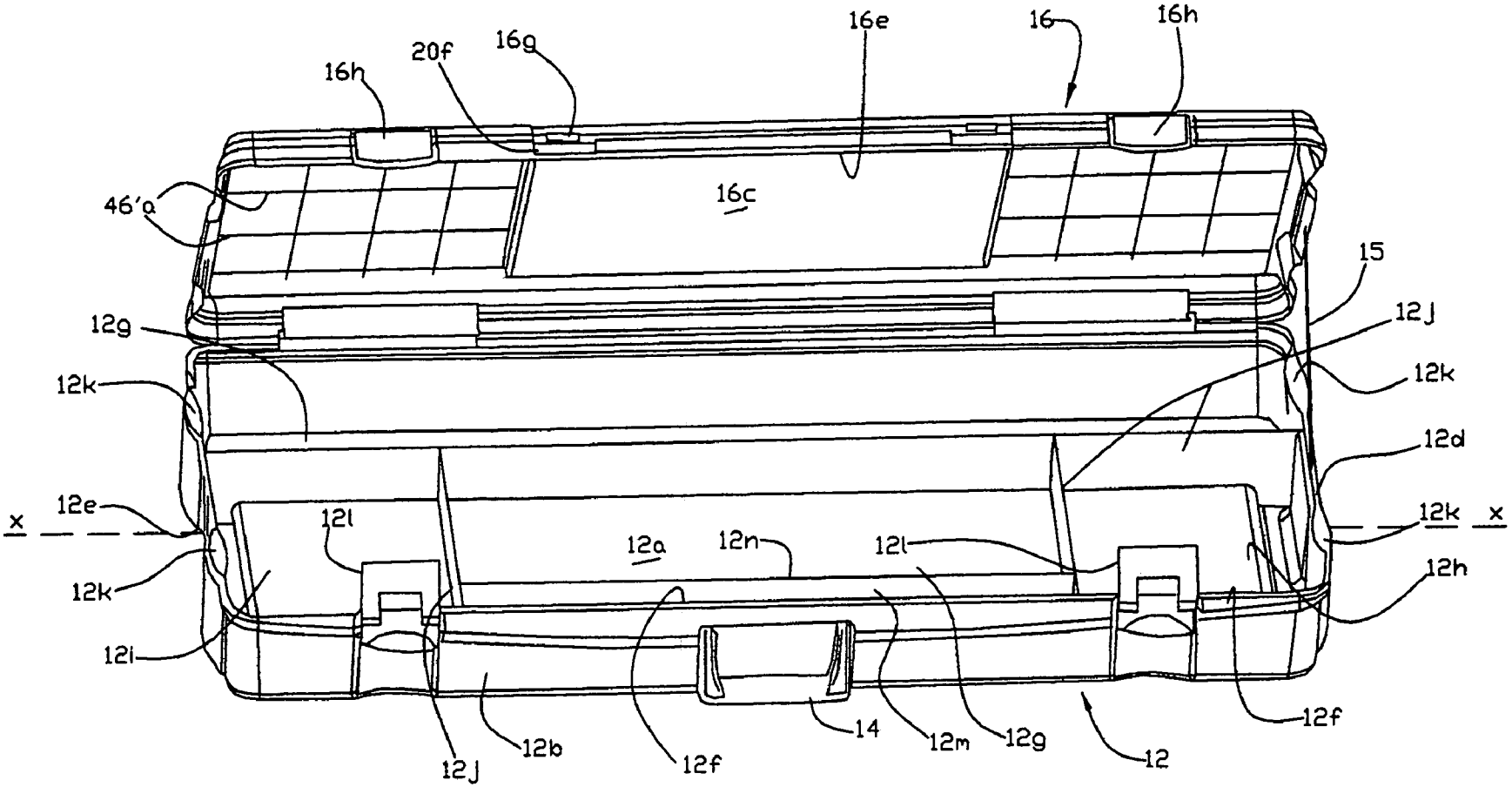
FIG. 1 is a front perspective view of the gift wrapping center in the form of a table assembly with the primary lid open and the legs retracted showing the available storage areas.
Figure 2:
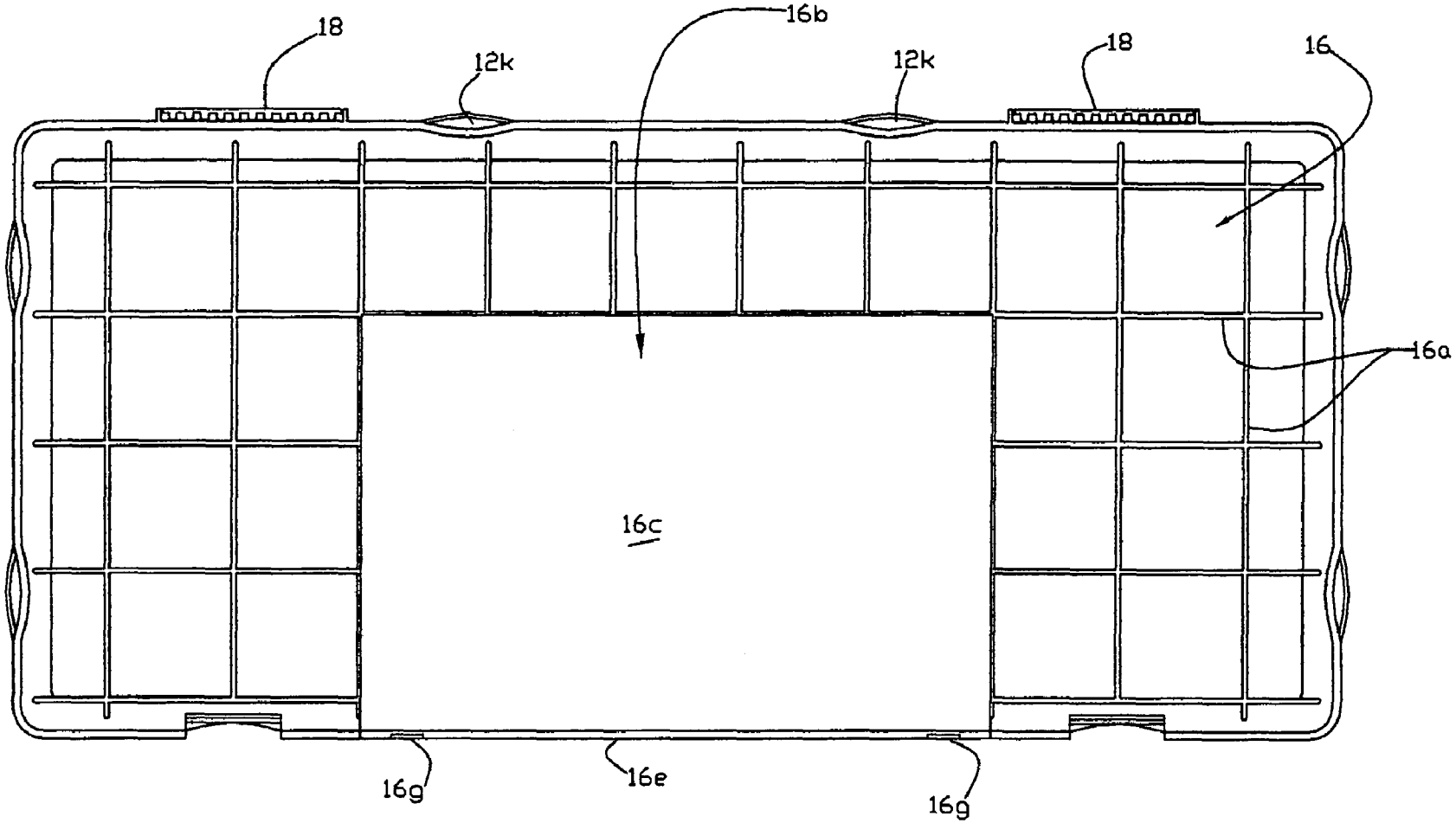
FIG. 2 is a top plan view of the primary lid.
Figure 3:
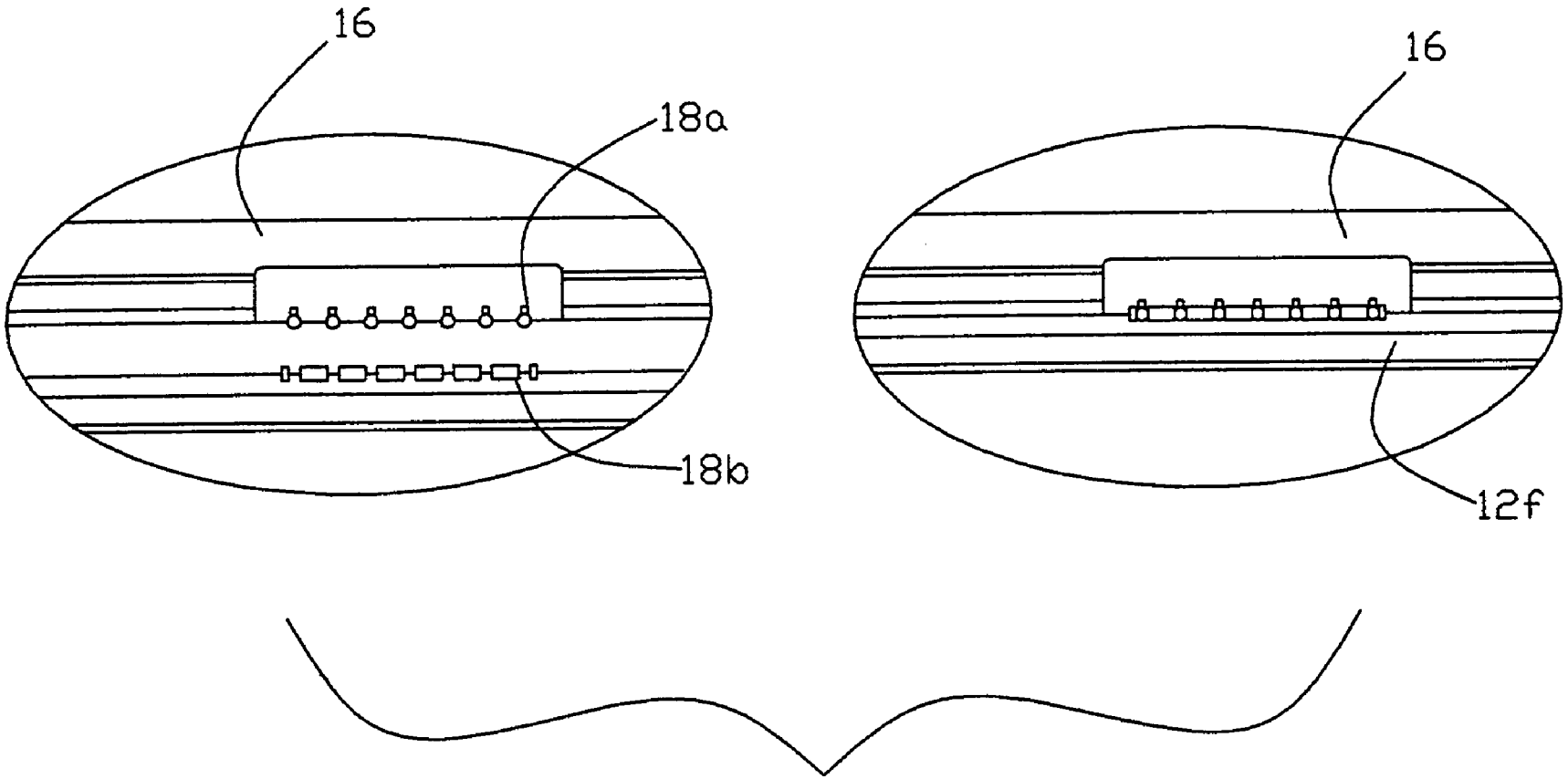
FIG. 3 contains two exploded views showing the hinge arrangement between the primary lid and the storage compartment.
Figure 15:
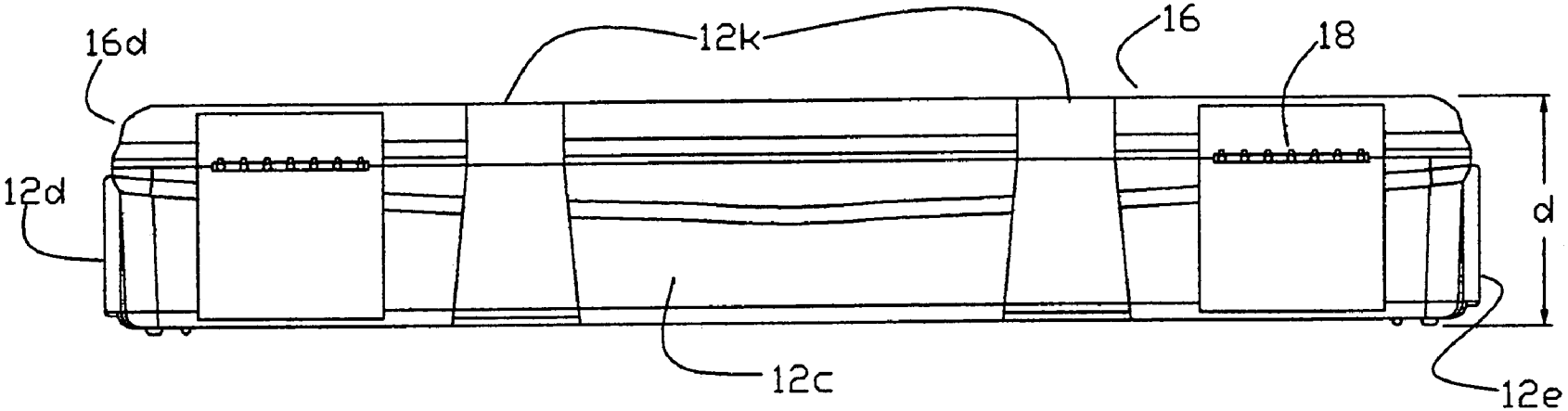
FIG. 15 is a rear elevational view of the table assembly with the legs deployed.

Referring now to FIGS. 1-3 a gift wrapping/stationary center in the form of a table assembly 10, in accordance with the present invention, includes a bottom section in the form of a rectangular storage compartment 12 aligned along a longitudinal axis x-x with a bottom wall 12*a*, front wall 12*b*, back wall 12*c* (FIG. 15) and opposed side walls 12*d* and 12*e* extending upwardly from the bottom wall and terminating in a peripheral rim 12*f*. The storage compartment defines a main storage area 12*g* for storing 24" and 30" wrapping paper rolls 28, and 40" rolls 30. See FIG. 16. The storage compartment further defines second and third storage areas, 12*h* and 12*i*, partitioned off of the main storage area by partition walls 12*j*. An envelope storage area 12*m* is formed between the inner surface of the front wall 12*b* and a partition wall 12*n*. Two elliptical open ended receptacles 12*k* are formed in each side wall and the back wall for releasably mounting a utility module and wrapping paper support clips to the storage compartment as will be discussed in more detail. See FIG. 4A. The apex 12'*k* of the receptacles 12*k* on the back or side walls are aligned in a plane which allows the assembly 10 to be vertically positioned on its back or side walls when not in use. A handle 14 is pivotally mounted to the front wall of the storage compartment and a foldable leg assembly 22 is mounted under the bottom wall as will be explained.

Figure 4:
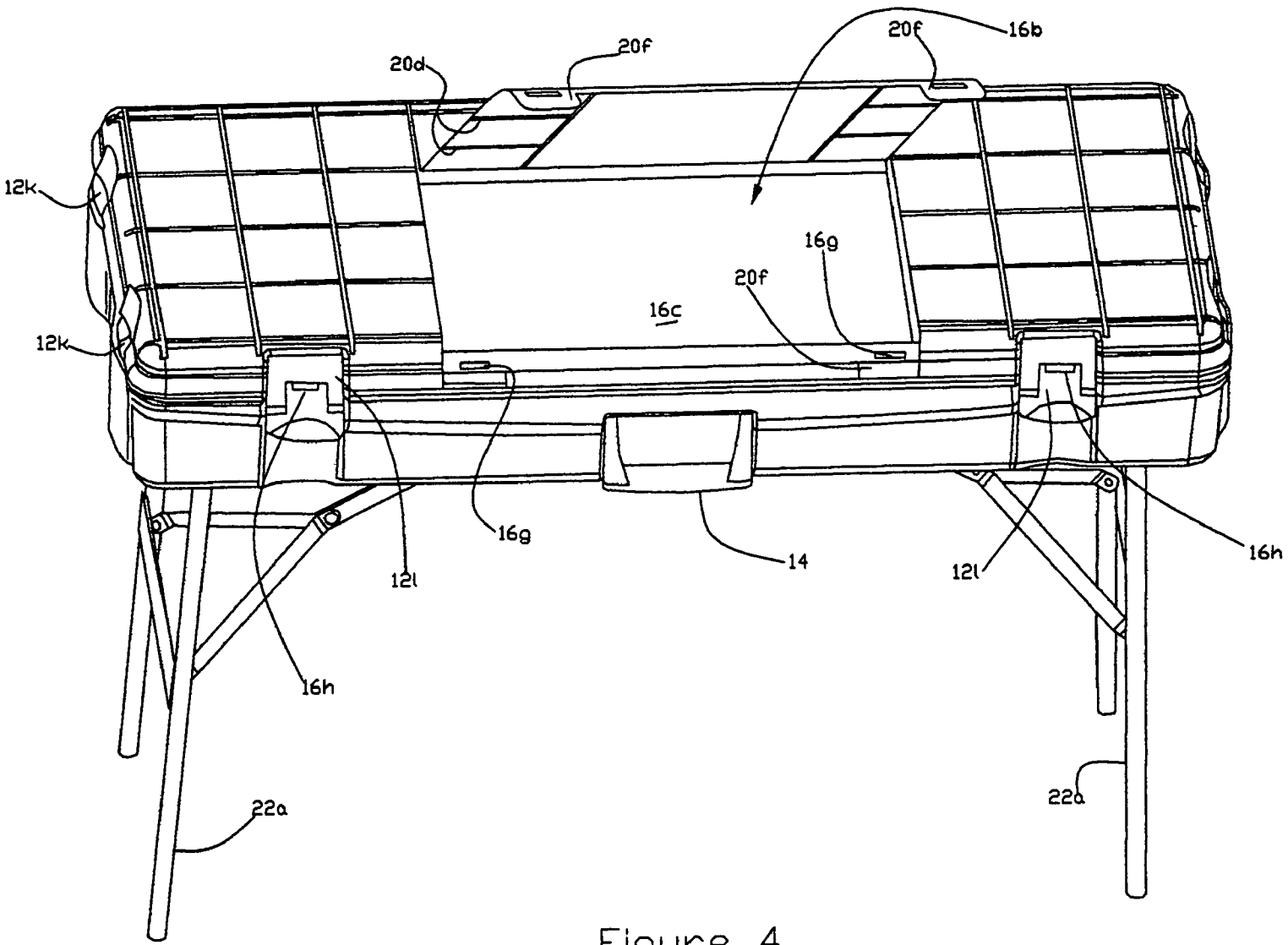
FIG. 4 is a perspective view of the table assembly with the legs deployed and the secondary lid open.
Figure 4A:
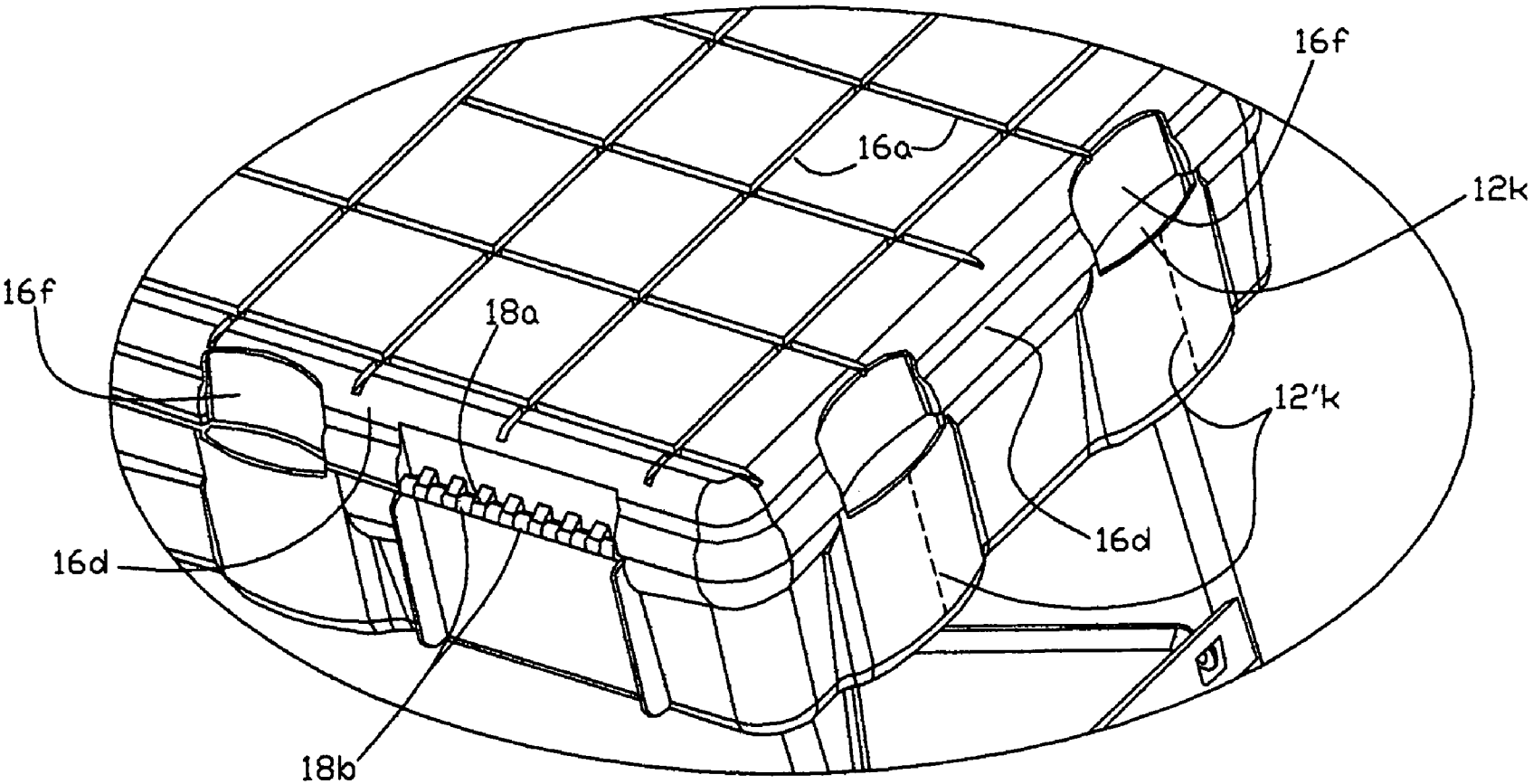
FIG. 4A is a broken away perspective view of one corner of the table assembly with lids closed showing the receptacles formed along the rim of the storage compartment.

The table assembly has a top section in the form of a primary lid 16 (FIG. 2) connected to the back peripheral rim of the compartment via hinge 18 comprising protruding spherical pins 18*a*, located on the lid, and cooperating sockets 18*b*, located on the back peripheral rim 12*d*, as is illustrated in FIGS. 3 and 4A. A flexible strap 15 is connected between a side wall of the primary lid and storage compartment to retain the lid in an open position at a given angle beyond 90° but less than 180°. The primary lid is releasably locked to the storage compartment via over center latch handles 121 with engage latch hooks 16*h* on the lid.

The primary lid is provided with orthogonal grooves 16*a* formed on the top surface thereof to provide guides to aid a user in making a straight cut in wrapping paper laid thereon. Parallel grooves are preferably spaced equidistance from each other, e.g., 4" apart. The underside of the lid has ribs 16'*a* which narrow the grooves. See FIG. 1. Referring now to FIG. 4, a perspective view of the table assembly with the legs in the deployed position, and to FIG. 1, the primary lid defines a shallow, e.g., 1" deep, centrally located fourth storage area 16*b*, e.g., 16"×12", for storing writing materials such as writing paper, cards, tags etc. (not shown). The storage area 16*b* is formed by a bottom wall 16*c* with front, back and opposed side walls (not separately identified) extending upwardly from the bottom wall to an open top as is illustrated in FIG. 4. The primary lid is formed with a downwardly extending peripheral wall 16*d* which terminates in a rim 16*e* which engages the storage compartment rim 12*d* in the closed position. The primary lid peripheral wall forms concave cutouts 16*f* where the wall meets the receptacles 12*k* to accommodate the insertion of the utility module and wrapping support clips into the receptacle.

Figure 5:
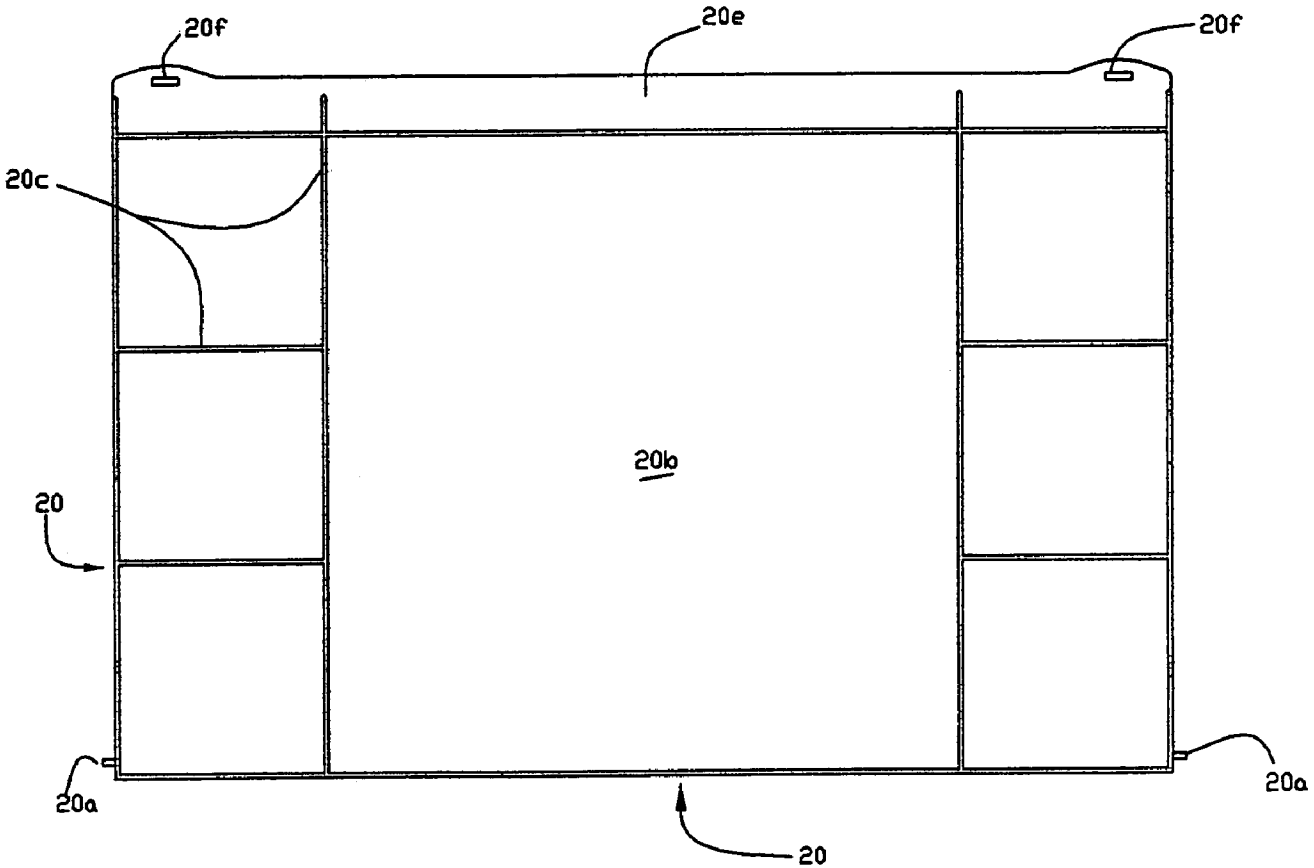
FIGS. 5 and 6 are top plan and side views of the secondary lid, respectively.
Figure 6:
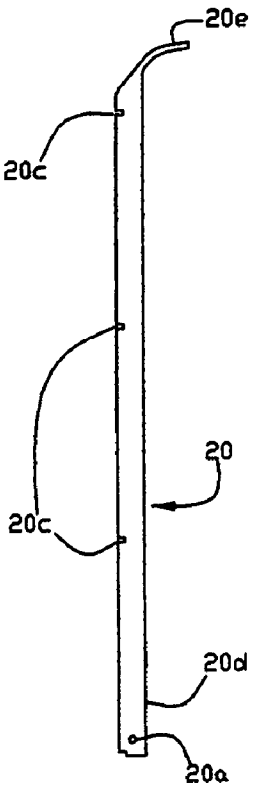

Referring now to FIGS. 5 and 6 a secondary or accessory lid 20 is hinged to primary lid via stub hinge pins 20*a* which nest in blind bores (not shown) in the inner back edge of the primary lid. The secondary lid has a centrally located upper smooth writing surface 20*b*, e.g., 12"×12", framed with orthogonal grooves 20*c* aligned with the adjacent grooves on the primary lid. The underside of lid 20 is formed with orthogonal ribs 20*d* which mirror the grooves 20*c*. The secondary lid overlies and encloses the accessory or stationary storage area 16*b* and includes a curved front section 20*e* with apertured tongues 20*f* which are arranged to snap over latching tabs 16*g* on the front rim 16*e* of the primary lid to releasably retain the secondary lid in a closed position on the primary lid. See FIG. 14.

Figure 7:
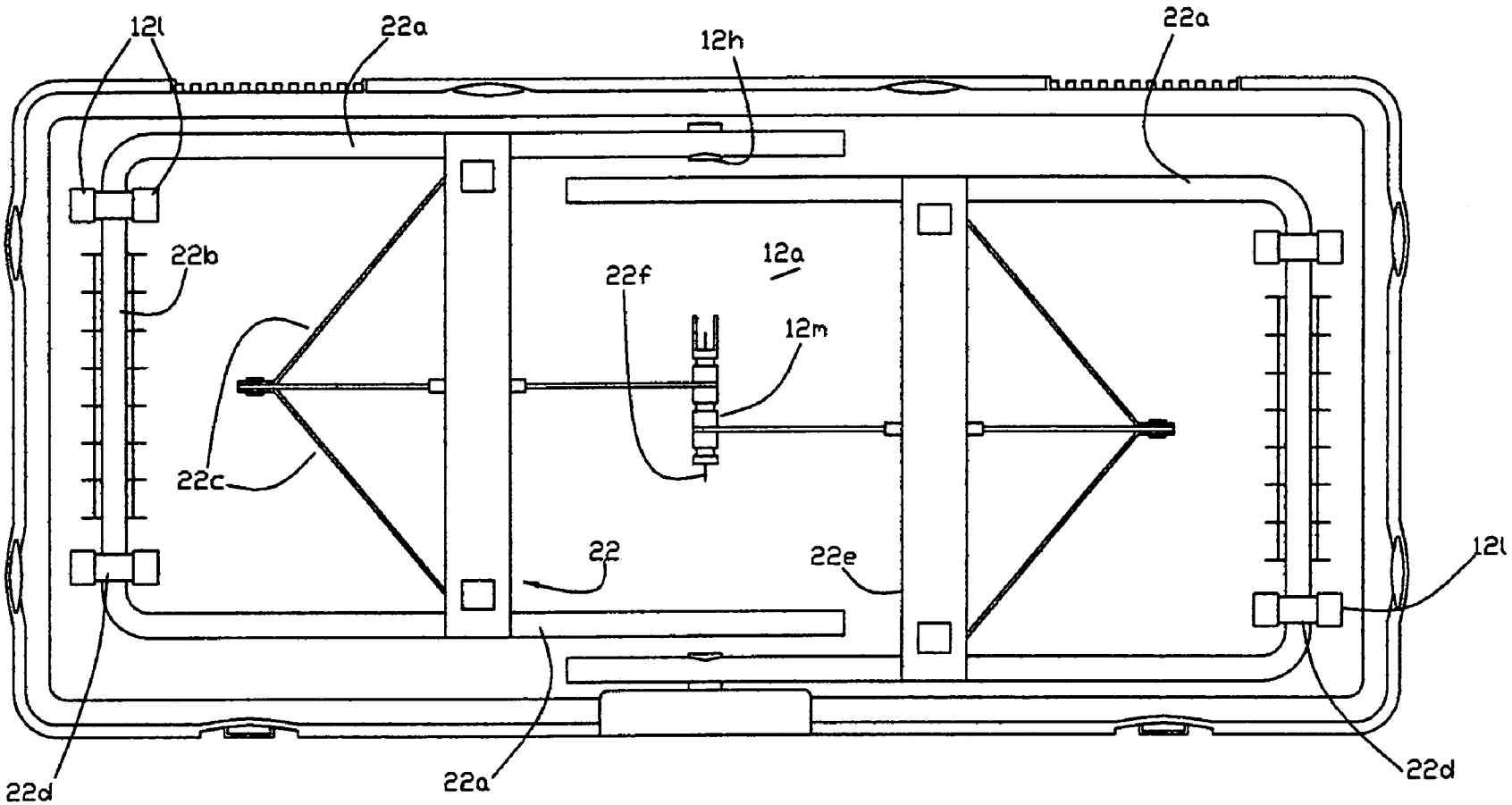
FIG. 7 is a bottom view of the table assembly with the legs retracted.
Figure 8:
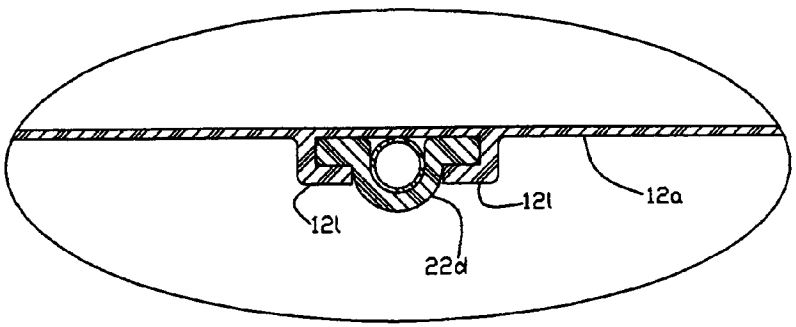
FIG. 8 is an exploded cross-sectional view showing the mechanism for pivotally securing the legs to the compartment bottom wall.

Referring now to FIGS. 7 and 8, a foldable leg assembly 22 is secured to the underside of the compartment bottom wall 12*a*. The leg assembly comprises tubular legs extensions 22*a* joined to tubular horizontally aligned axle sections 22*b*, preferably made of steel. The axle sections are pivotally secured to the wall 12*a* via downwardly extending flanges 12*l* (molded integrally with the compartment) and retaining clips 22*d* which are slid into horizontal grooves between adjacent flanges, preferably as soon as the compartment is removed from the mold, i.e., while the plastic is still somewhat flexible. See FIG. 8. When the plastic, e.g., thermoplastic, cools and sets the flanges clamp and retain the clips and axle sections in place. Metal straps 22*c*, hinged to the leg extensions via plates 22*e* and the center of compartment bottom wall via a pin 22*f* inserted through an end of the straps and apertured stubs 12*m*, complete the leg assembly in a conventional manner. Retaining clips 12*h* hold the retracted legs in place. The front, back and side walls of the storage compartment extend downwardly below the bottom wall a sufficient distance, e.g., 1", to shield the retracted legs from a side view.

It is to be noted that while the foldable legs enhance the utility of the center it can serve a useful purpose without the addition of legs. In this case, a user may place the unit comprising the storage compartment hinged lids on the floor, bed or other convenient surface for use.

Figure 9:
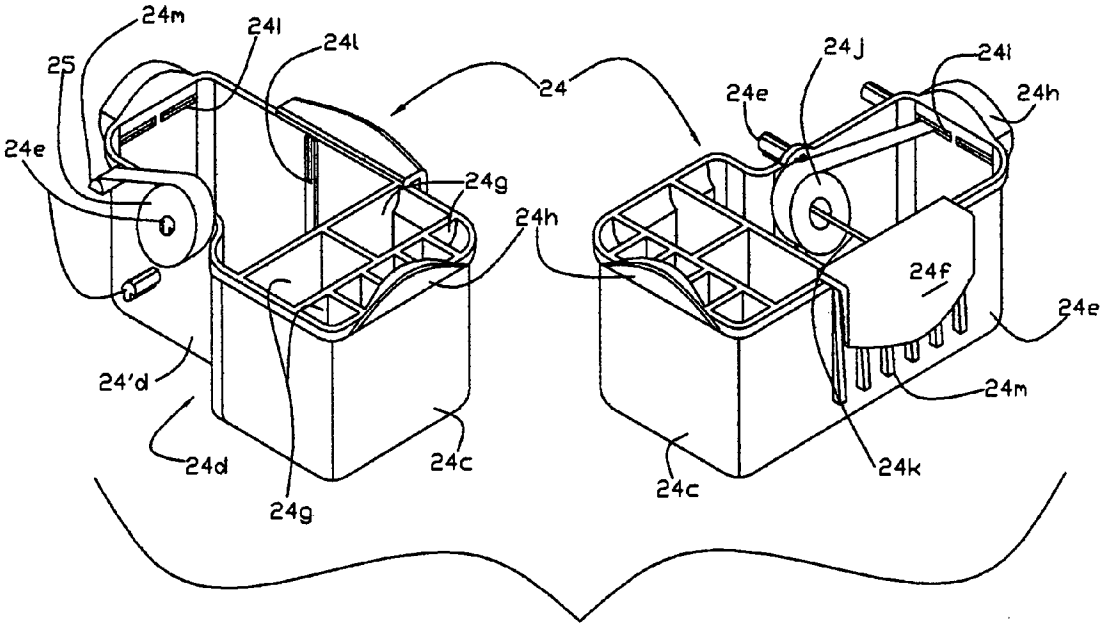
FIG. 9 contains two perspective views of the utility module.
Figure 14:
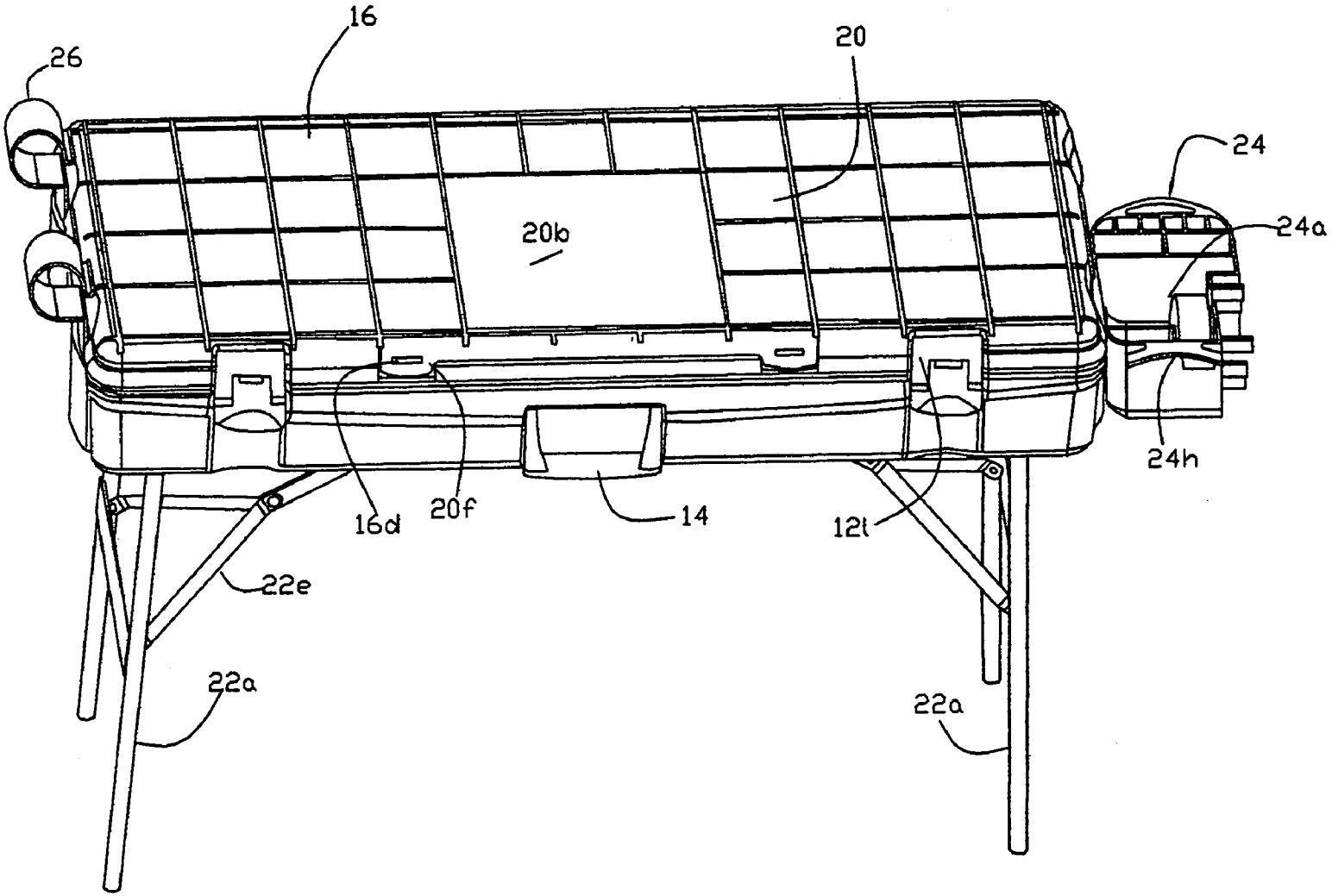
FIG. 14 is a perspective view of the table assembly with the utility module and two roll holding clips mounted on opposite side walls of the storage compartment.

An integrally molded utility module or basket 24 for holding an adhesive tape roll, ribbon spools, and wrapping accessories is illustrated in FIG. 9. The utility module is formed with a open top, bottom wall 24*a* (FIG. 6), front (24*b*) back (24*c*) and opposed side walls 24*d* and 24*e*. A front portion 24'*d* of the side wall 24*d* is indented inwardly to provide room for two rolls of adhesive tape, single or doubled sided, e.g., Scotch Tape®, to be mounted on stubs 24*e* which extends horizontally outwardly from the indented wall portion 24'*d*. The side wall 24*e* is formed with an elliptically-shaped mounting post 24*f* which extends outwardly from the side wall for placement in one of the storage compartment receptacles as is illustrated in FIG. 14. As is illustrated in FIG. 9, a roll of adhesive tape 25 is supported on the upper stub 24*e* in line with a cutting blade 24*m*.

The utility module includes compartments 24*g* for storing scissors, bows and other wrapping accessories. The front and back walls have upwardly extending semicircular sections 24*h* which serve as handles. The front wall is provided with apertures 24*i* through which ribbon from spools 24*j* supported on rod 24*k*, slidably received in slotted guides 24*l* formed on the interior of the side wall. Tapered ribs 24'*m*, formed on the wall 24*e* and spaced inwardly from the inner surface of the post 24*f* serve to compensate for the draft angles in the compartment and module side walls so that the module will be positioned horizontally when mounted in one of the receptacles. The utility module may be mounted on either side wall and conveniently be stored in compartment storage area 12*h* when not in use. See FIG. 16.

A wrapping paper roll clip 26 is illustrated in FIGS. 10-13. A pair of roll clips, when mounted in appropriate receptacles, will support a roll along and above the side or back of the table. The roll clip is formed with a generally c-shaped hook portion 26*a* supported on a elliptically-shaped post portion 26*b* formed with vertically extending strengthening ribs 26*c*. The hook portion 26*a* is somewhat resilient and formed with a semicircular front end 26*d* which extends the opening in the hook when a roll of paper is inserted therein. The post is arranged to be inserted into one of the storage compartment receptacles so that two roll clips can be mounted on one of the side walls or back wall to support a wrapping paper roll above the table lids in their closed position.

The table assembly with the legs deployed to raise the table top or work surface to a conventional table height, e.g., 30.5" with the utility module mounted on one side wall and the roll clips mounted on the other side wall is illustrated in FIG. 14. The primary and secondary lids in their closed position provide a flat work surface on which paper drawn from a roll held in the roll clips can be measured and cut, with or without the article to be wrapped sitting on the paper. It is to be noted that the primary lid can be raised with the utility module and roll clips in place in the receptacles. A back elevational view of the table assembly with the legs retracted in shown in FIG. 15.

Figure 16:
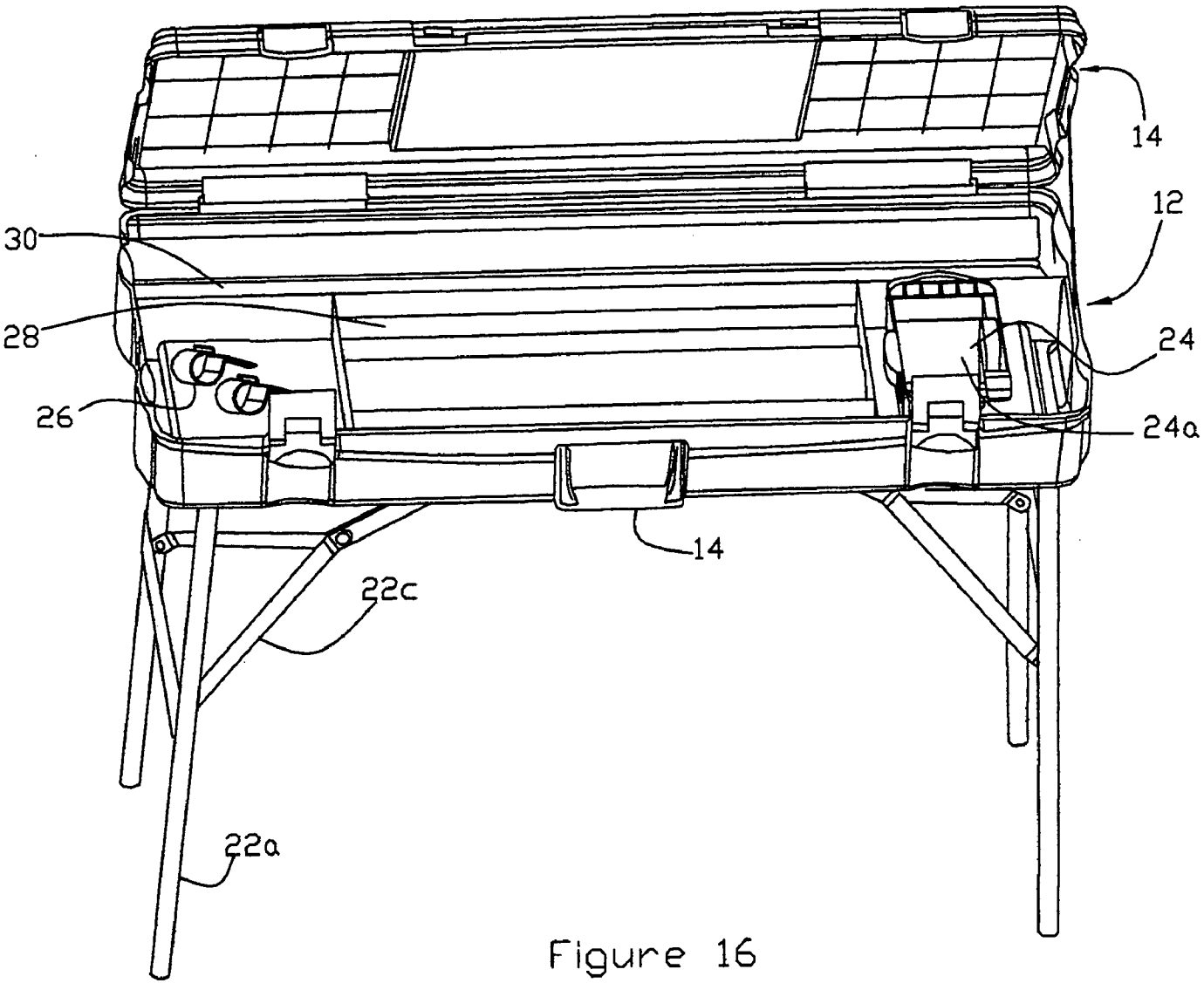
FIG. 16 is a perspective view of the table assembly with the primary lid open showing rolls of wrapping paper, the utility module and the paper clips stored in the storage compartment.

FIG. 16, a perspective view of the table assembly with the primary lid open, shows wrapping paper rolls 28 and 30, the utility module 24 and roll clips 26 in place in the storage compartment. The length and width of the assembly may vary. As an example, such dimensions are readily ascertainable from the drawings if a specified spacing, e.g., 4", between adjacent grooves are used. The overall outside depth d (FIG. 6) of the assembly is preferably small enough to permit the assembly to be stored under a conventional bed, e.g., about 6½". Using this dimension as an example, the depth inside of the enclosed storage compartment will be about 5½" except for the area under the bottom wall 16*c* of the primary lid. The table assembly may be readily stored under a conventional bed with the work surface parallel to the floor or in a closet with the work surface perpendicular to the floor.

The several components of the table assembly are preferably molded from a suitable rigid or semi-rigid thermoplastic material of, for example, the polyolifin group, such as high density polyethylene, more preferably polypropylene. Polypropylene is believed to be the least expensive of most commonly used plastics for molding many consumer products and thus advantageous from a cost standpoint. Each component (except for the legs), i.e., the storage compartment, the primary and secondary lids, the utility module and roll clips, are integrally molded as one piece items and then assembled. The plastic may be transparent or colored.

There has thus been described a novel, portable and user friendly universal table assembly for storing gift wrapping as well as some stationary supplies and for facilitating the use of such supplies. The multipurpose table may also be used for other purposes as pointed out previously. While only a preferred embodiment of the invention has been disclosed, modifications thereof may occur to those skilled in the art. For example, though somewhat less useful, the assembly may be made by replacing the primary and secondary lids with a single lid. Accordingly, the appended claims are intended to cover all embodiments which do not depart from the spirit and scope of the invention.

What is claimed is:

1. A portable gift wrapping/stationary center for storing wrapping and stationary supplies and facilitating their use comprising:

a) a rectangular storage compartment having a bottom wall and front, rear and side walls extending upwardly from the bottom wall and terminating in a peripheral rim; the storage compartment including a main storage area for accommodating a plurality of rolls of wrapping paper;

b) a primary lid hinged to the back peripheral wall of the compartment for pivoting between an open and a closed position and defining an additional centrally located shallow open storage area therein for holding sheets of writing paper, cards and writing instruments, the top surface of the primary lid defining a plurality of orthogonal grooves therein;

c) a secondary lid hinged to the primary lid for enclosing the storage area formed within the primary lid, the top surface of the primary and secondary lids providing a flat work surface for supporting an article to be wrapped; and d) a plurality of foldable table legs pivotally connected to the bottom wall of the compartment adjacent the side walls to allow the table legs to be raised to a desired table height or folded to allow the center to be stored under a conventional bed.

2. The invention of claim 1 further including a utility module having a bottom and front, rear and opposed side walls extending upwardly from the bottom wall, the module having means for supporting at least one roll of adhesive tape and a blade for cutting the tape disposed adjacent one side wall, the utility module being dimensioned to be positioned within the compartment storage area with the lids in a closed position, at least one side wall of the compartment and the utility module having cooperating mounting means to releasably mount the utility module on the outside of said compartment side wall whereby a user will have access to the tape with the lids in the closed position.

3. The invention of claim 2 wherein an area of the upper surface of the secondary lid is substantially smooth to form a writing surface.

4. The invention of claim 3 wherein the utility module further includes means for supporting a plurality of rolls of ribbon therein.

5. The invention of claim 4 including a pair of roll holding clips and wherein at least one of the side walls of the compartment and the roll holding clips have cooperating means to releasably mount the clips to a compartment side wall so that a user has access to the clips with the lids in a closed position.

6. The invention of claim 5 wherein each side wall of the compartment is formed with at least one receptacle open at the top and the utility module is formed with a mounting post extending downwardly along one side wall, which post is arranged to be releasably positioned within a receptacle to form the cooperating mounting means.

7. The invention of claim 6 including a handle pivotally mounted on the front wall of the storage compartment.

8. The invention of claim 7 wherein each of the compartment side walls defines a pair of spaced receptacles and wherein each of the roll holding clips is in the form of a c-shape with a downwardly extending mounting post which is arranged to be releasably positioned within one of the receptacles.

9. The invention of claim 8 wherein the primary lid is formed with a peripheral wall extending downwardly from the work surface terminating in a peripheral rim arranged to engage the storage compartment rim in the closed position.

10. The invention of claim 9 wherein each of the side walls and the back wall define a pair of spaced receptacles.

11. The invention of claim 10 wherein the storage compartment defines an area adjacent the interior surface of the front wall for receiving envelopes.

12. A portable table assembly for storing wrapping paper and accessories and facilitating the use thereof comprising:

a) an integrally molded rectangular storage compartment having a bottom wall with front, back, and opposed side walls extending upwardly from the bottom and terminating in a rim defining an open top, the storage compartment providing a main storage area for accommodating rolls of wrapping paper and at least one separate storage area for accommodating a utility module, the storage compartment defining at least one receptacle on a side wall thereof;

b) at least one lid hinged to the back peripheral wall of the compartment and forming a top flat work surface with orthogonal grooves therein;

c) a utility module having a bottom and front, back and opposed side walls extending upwardly from the bottom wall, the module having means for supporting at least one roll of adhesive tape and a blade for cutting the tape disposed adjacent one side wall and having a post formed on one side wall of the module adapted to be inserted into said at least one receptacle in the storage compartment side wall so that a user will have access to the utility module and the tape dispenser with the lid closed, the utility module being dimensioned to be positioned within said at least one separate storage area in the storage compartment; and d) a plurality of foldable legs pivotally mounted under the bottom wall of the storage compartment to allow the table legs to be raised to desired table height or folded to allow the assembly to be stored under a conventional bed.

13. The table assembly of claim 12 wherein the utility module is provided with means for rotatably mounting at least one ribbon spool therein.

14. The table assembly of claim 13 wherein the storage compartment defines at least two spaced receptacles on the side wall opposite the side wall defining at least one receptacle and further including a pair of wrapping paper roll holding clips, each clip having an upper c-section for holding an end of a roll and a downwardly extending post adapted to be inserted into a receptacle.

15. The table assembly of claim 14 wherein the storage compartment rim defines a pair of spaced receptacles on each side wall.

16. The table assembly of claim 15 wherein the lid is arranged to be opened with the utility module or roll clips mounted in the receptacles.

17. The table assembly of claim 16 wherein the lid is formed with a peripheral wall extending downwardly from the work surface and wherein the peripheral wall terminates in a peripheral rim which mates with the storage compartment rim and wherein the lid peripheral wall is formed with inwardly extending cut-outs aligned with the receptacles.

18. The table assembly of claim 17 wherein said at least one lid comprises a primary lid hinged to the storage compartment along the back wall, the primary lid defining a centralized shallow storage compartment open at the top and a secondary lid hinged to the primary lid and enclosing the shallow storage compartment when closed on the primary lid.

19. The table assembly of claim 18 further including a handle pivotally mounted on the front wall of the storage compartment.

20. The table assembly of claim 19 further including latching means for releasably securing the primary lid to the storage compartment.

21. The table assembly of claim 20 further including latching means for releasably securing the secondary lid to the primary lid.

22. A portable gift wrapping center for storing wrapping and stationary supplies and facilitating their use comprising:

a) a rectangular storage compartment having a bottom wall and front, rear and side walls extending upwardly from the bottom wall and terminating in a peripheral rim; the storage compartment including a main storage area for accommodating a plurality of rolls of wrapping paper;

b) a primary lid hinged to the back peripheral wall of the compartment for pivoting between an open and a closed position and defining a centrally located shallow open storage area therein for holding sheets of writing paper, cards and writing instruments, the top surface of the primary lid defining a plurality of orthogonal grooves therein; and c) a secondary lid hinged to the primary lid for enclosing the storage area formed in the primary lid, the top surface of the primary and secondary lids providing a flat work surface for supporting an article to be wrapped.

23. The gift wrapping center of claim 22 further including a utility module having a bottom and front, rear and opposed side walls extending upwardly from the bottom wall, the module having means for supporting at least one roll of adhesive tape and a blade for cutting the tape disposed adjacent one side wall, the utility module being dimensioned to be positioned within the secondary storage area with the lids in a closed position, at least one side wall of the compartment and the utility module having cooperating mounting means to releasably mount the utility module on the outside of said compartment side wall whereby a user will have access to the tape with the lids in the closed position.

24. The gift wrapping center of claim 23 wherein an area of the upper surface of the secondary lid is substantially smooth to form a writing surface.

25. The gift wrapping center of claim 24 wherein the utility module further includes means for supporting a plurality of rolls of ribbon therein.

26. The gift wrapping center of claim 25 including a pair of roll holding clips and wherein at least one of the side walls of the compartment and the roll holding clips have cooperating means to releasably mount the clips to a compartment side wall so that a user has access to the clips with the lids in a closed position.

27. The gift wrapping center of claim 26 wherein each side wall of the compartment is formed with at least one receptacle open at the top and the utility module is formed with a mounting post extending downwardly along one side wall, which post is arranged to be releasably positioned within a receptacle to form the cooperating mounting means.

28. The gift wrapping center of claim 27 including a handle pivotally mounted on the front wall of the storage compartment.

29. The gift wrapping center of claim 28 wherein each of the compartment side walls defines a pair of spaced receptacles and wherein each of the roll holding clips is in the form of a c-shape with a downwardly extending mounting post which is arranged to be releasably positioned within one of the receptacles.

30. The gift wrapping center of claim 29 wherein the primary lid is formed with a peripheral wall extending downwardly from the work surface terminating in a peripheral rim arranged to engage the storage compartment rim in the closed position.

31. The gift wrapping center of claim 30 wherein each of the side walls and the back wall define a pair of spaced receptacles.

* * * * *